United States Patent [19]

Milstein

[11] Patent Number: 4,630,312

[45] Date of Patent: Dec. 16, 1986

[54] LAUNDRY BAG FOR NYLON HOSIERY AND THE LIKE

[76] Inventor: Elisabeth M. L. Milstein, 355 Colorado Blvd., Denver, Colo. 80206

[21] Appl. No.: 236,533

[22] Filed: Feb. 20, 1981

[51] Int. Cl.[4] ..... B65D 30/06; B65D 30/28; B65D 33/16; B65D 85/18

[52] U.S. Cl. ..... 383/86; 383/102; 383/117; 383/120; 383/907

[58] Field of Search ..... 150/1, 1.7, 1.8, 3, 150/7; 383/84, 86, 102, 117, 120, 907

[56] References Cited

U.S. PATENT DOCUMENTS

| | | | |
|---|---|---|---|
| 1,915,196 | 6/1933 | McGuire | 150/1 X |
| 2,173,288 | 9/1939 | Shapiro | 150/8 |
| 2,602,482 | 7/1952 | Lyon | 150/1 |
| 2,616,469 | 11/1952 | Katz et al. | 150/1 |
| 3,036,616 | 5/1962 | Allen | 150/3 X |
| 3,331,221 | 7/1967 | Lawson, Jr. | 66/170 |
| 3,369,584 | 9/1968 | Faccio et al. | 150/3 |
| 3,422,867 | 1/1969 | Wu | 150/3 |
| 3,632,029 | 1/1972 | Sonner | 224/29 D |
| 4,010,785 | 3/1977 | Patik | 150/7 |
| 4,079,767 | 3/1978 | Howard | 150/3 |
| 4,120,335 | 10/1978 | Mitchell | 150/7 |

FOREIGN PATENT DOCUMENTS

| | | | |
|---|---|---|---|
| 1202996 | 8/1970 | United Kingdom | 150/1 |

*Primary Examiner*—William Price
*Assistant Examiner*—Sue A. Weaver
*Attorney, Agent, or Firm*—John E. Reilly

[57] ABSTRACT

An improved laundry bag construction of generally trapezoidal configuration composed of a durable open-weave material, such as fine gauge nylon net, for secure but thorough machine-laundering and/or drying of articles made from delicate fabrics, such as hosiery or lingerie, is disclosed. The sides of the bag structure are of the same length as the width of the lower end of the bag and the lower end is on the order of two to three times the width of the bag's upper end. The open edges of the upper end of the bag are gathered and stitched to cloth bands which have a hook and thistle closure arrangement, such as that sold under the trademark VELCRO, one of which bands overlaps the other to effect secure sealing of the bag.

2 Claims, 4 Drawing Figures

LAUNDRY BAG FOR NYLON HOSIERY AND THE LIKE

This invention relates to a novel and improved laundry bag, and more particularly relates to a bag for safely machine-laundering articles constructed from delicate or fragile fabrics, such as, nylon hosiery, lingerie and the like.

BACKGROUND AND FIELD OF THE INVENTION

An inexpensive, safe device for thorough machine-laundering of articles made from delicate fabrics has been a long-recognized need. Such factors as bag capacity, handling efficiency, wear resistance and ability to withstand frequent and repeated washing of the bag itself as well as adequate fastening means to securely retain articles therein without sustaining damage which might occur if the articles were caught by a zipper or snaptype closure have been considered. In the past, bags of the type referred to have not met all of these criteria; nor have they been constructed of a material, such as fine gauge nylon mesh, to enable the articles to be loosely retained while being thoroughly and safely machine-washed and dried. Among bags constructed for similar purposes, there is shown in U.S. Letters Pat. No. 2,602,482 to Lyon a rectangular bag of open-mesh cotton or nylon material with either a snap-type or zipper closure in the middle or top side of the bag. U.S. Letters Pat. No. 3,331,221 relates to a knitted fabric bag for protection of articles being treated in cleaning solvents and the like. U.S. Letters Pat. No. 4,079,767 illustrates a waterproof bag with an open mouth or closure composed of mating fastener strips, such as sold under the trademark VELCRO, to effect sealing of the bag. U.S. Letters Pat. No. 3,422,867 to Wu sets forth a laundry bag construction consisting of an inner lining closed by a slide fastener, the inner lining being permanently or removably attached in an outer casing of toweling or other absorbent material. In such devices and others known in the art, various fabrics and closure means have been employed for similar uses but none provide the simplified and economical approach for thorough and safe cleansing of fragile or delicate articles of apparel as the bag of the present invention.

SUMMARY OF THE INVENTION

It is therefore an object of the present invention to provide for a novel and improved fine gauge open mesh bag of trapezoidal configuration for use in machine-laundering and drying of articles made from delicate fabrics, such as, nylon hosiery and the like.

Another object of the present invention is to provide for a novel and improved laundry bag for fragile articles of apparel designed to permit the entire surface thereof to accommodate free flow of water and/or air therethrough so as to permit thorough washing and drying of the articles loosely enclosed therein.

A further object of the present invention is to provide a bag structure having a fold-over, flap-type closure of hook and thistle construction, such as, that sold under the trademark VELCRO, which closure enables easy access to articles therein as well as providing secure retention of the articles during machine washing and drying laundry cycles.

Yet another object of the present invention is to provide a novel and improved bag constructed of two sides sewn by regular stitching the same length as the lower end thereof, the lower end being two to three times longer than the upper end, and the upper end being gathered along its edges and stretch stitched to a hook and thistle closure to provide limited resiliency at the opening.

A still further object of the present invention is to provide a novel and improved laundry bag for fragile articles of simplified and economical construction composed of fine gauge open mesh which will withstand numerous washing and drying cycles.

Another object of the present invention is to provide a laundry bag of convenient size and capacity for machine-laundering or drying of delicate articles having closure means at its narrow upper end to insure safe retention of the articles therein while avoiding likelihood of damage to the fabric which might occur if the article became enmeshed in conventional zipper or snap-type closures.

In accordance with the present invention, a laundry bag of generally trapezoidal configuration is characterized in particular by having its sides and lower, relatively wide end of equal length. The lower end of the bag is on the order of two to three times the length of the upper end, the upper end being gathered at its edges and stretch-stitched to a hook and thistle closure so as to provide a limited degree of resiliency when the bag is opened and closed and to afford easy access to articles in the bag. The bag of the present invention is constructed from fine gauge nylon or other durable net material to permit virtually the entire surface thereof to be freely penetrated by machine-washing and drying cycles while contributing to wearability of the bag itself. Articles of hosiery or lingerie are loosely but securely retained during machine laundry cycles to effect thorough cleaning. Articles within the bag are easily accessible through the hook and thistle closure, and the likelihood of tearing or damage to delicate fabrics is eliminated since no metal is employed in the closure. Also, the upper flap section which contains the hook portion of the closure may be reverse-folded thereby preventing any contact with the articles being inserted in the bag. Further, the bag of the present invention is both simple and economical to manufacture and is of sufficient capacity to allow several articles to be machine-laundered and dried at the same time.

The above and other objects, advantages and features of the present invention will become more readily appreciated and understood from the foregoing detailed description of a preferred embodiment when taken together with the accompanying drawings, in which:

DETAILED DESCRIPTION OF THE PREFERRED EMBODIMENT

Figure 1:
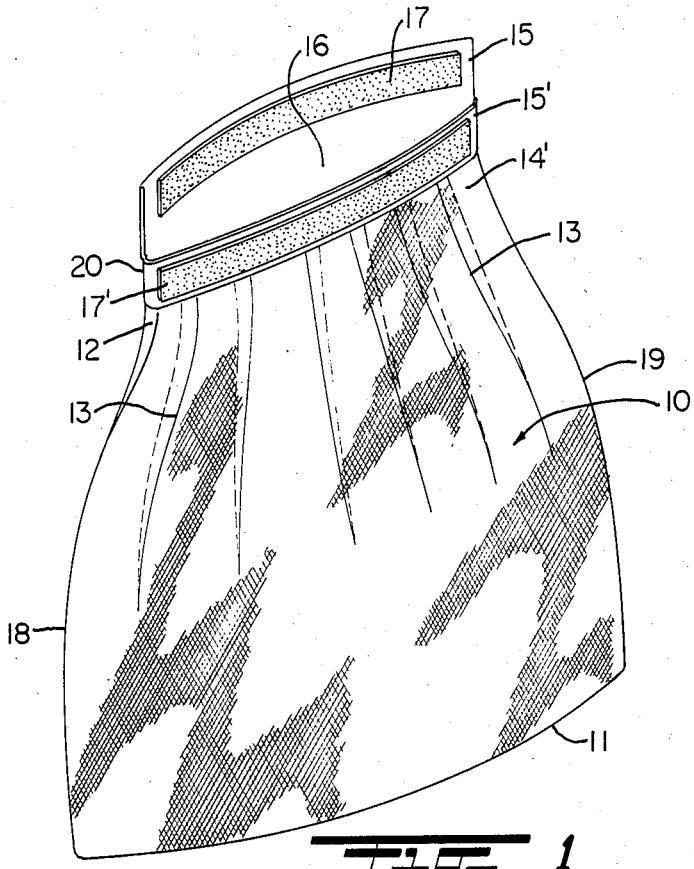
FIG. 1 is a front perspective view of the preferred form of bag in accordance with the present invention, with the edges of the opening laid back to disclose the hook and thistle closure.
Figure 3:
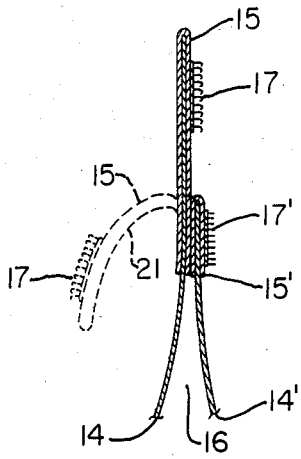
FIG. 3 is a fragmentary view comparable to FIG. 2 and illustrating in greater detail the attachment of the hook and thistle closure to the upper edges and with the reverse fold position shown in dotted lines.
Figure 2:
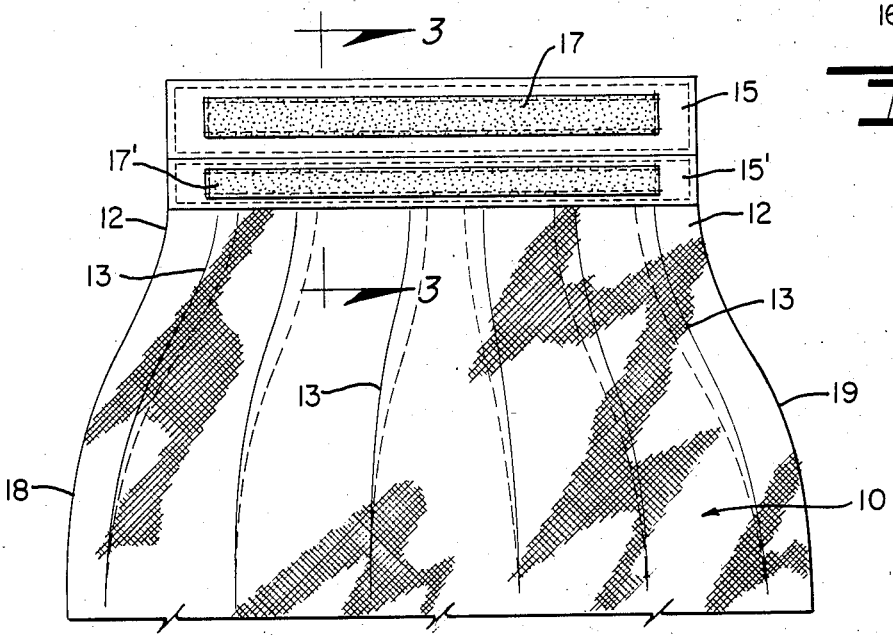
FIG. 2 is an enlarged view of a portion of the bag at the open end, showing in greater detail the gathering and stitching arrangement at the edges.

Referring in detail to the drawings, the preferred form of bag 10 in accordance with the present invention as shown in FIG. 1 is of generally trapezoidal construction having a lower end 11, sides 18, 19 and a narrow upper end 12. As illustrated, the bag 10 may be formed of a single piece of material folded upon itself at the lower end 11 and conventionally stitched or overcast along opposite sides 18 and 19, respectively. The sides 18 and 19 of bag 10 and lower end 11 are of equal length. Lower end 11 is two to three times the length of upper end 12 after attachment of the band portions 15 and 15' to upper edges 14 and 14', respectively. Specifically as illustrated in FIGS. 1 and 2, upper end 12 is gathered in a fold or pleat arrangement 13 on each of its edges 14, 14'. Edges 14, 14' are then sewn by conventional stretch stitching to cloth bands 15, 15', respectively to form a closure 16 across the upper end of the bag 10. In turn, closure 16 employs an arrangement of hook and thistle flap portions 17, 17', respectively, of the type sold under the trademark VELCRO. Hook flap portion 17 is conventionally stretch-stitched to band 15 and thistle flap portion 17' is sewn by conventional stitching to band 15' in matching relation. Pressure-sensitive sealing of closure 16 is effected when hook flap portion 17 is folded over or placed in overlapping relation to thistle flap portion 17', insuring secure retention of articles in bag 10. A limited degree of resiliency and expansion is also imparted to closure 16 of bag 10 during opening by the particular stitching arrangement employed, thereby contributing to ease of access to the articles therein. Further, as shown in FIG. 3, band 15 may be reverse-folded as shown at 21 so as to prevent any possible contact of articles with the hook portion 17 when inserted into the opening 16.

The material from which bag 10 of the present invention is constructed preferably of a fine gauge nylon net to accommodate free flow of water and/or air therethrough during washing and drying cycles, the gauge or mesh size being just slightly greater than that of nylon hosiery, or on the order of 30 denier weight. For purposes of illustration and not limitation, a single piece of material is folded over and conventionally stitched along outer sides 18 and 19, each side and lower end 11 being equal and approximately 18" in length. Upper end 12 is then gathered in a fold or pleat arrangement at each of its edges 14, 14' to form a width of approximately 8½".

Now referring in more detail to the construction and arrangement of the hook and thistle 17, 17' relative to bands 15, 15' of closure 16, as shown, band 15 is made from an elongated strip of cotton or other fabric folded over the upper edge 12, and a strip of rough VELCRO is conventionally stretch-stitched to the front of the band 15 to form the hook flap portion 17. The folds or pleats 13 of one edge 14 of upper end 12 are placed between the open edges of folded-over band 15, the hem of which is folded under and pleats 13 are then stretch-stitched in place. Similarly, band 15' is made from an elongated strip of cotton folded over the upper edge 14'. A strip of soft VELCRO is conventionally stitched to the front of band 15' to form thistle flap portion 17', and pleats 13' of the other edge 14' of upper end 12 are inserted between the open edges of folded over band 15', ½" hem of the band 15' is folded under and stretch-stitched in place. Finally, the corresponding side edges of bands 15, 15' are sewn together as shown in FIG. 1 at 20 to form a single seam with respective sides 18 and 19.

Figure 4:
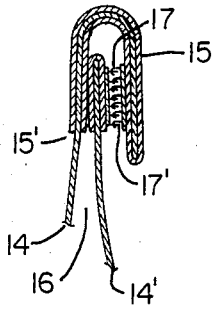
FIG. 4 is a cross-sectional view as shown in FIG. 3, showing the bag in the closed position.

As shown in FIG. 4, band 15 is overlapped or folded over band 15' so as to cause the hook portion 17 and thistle portion 17' to interengage and effect secure sealing along the upper end 12 of the bag 10. Further, the stitching arrangement employed provides a limited degree of resiliency and expansion to the resultant closure 16 to enable easy access to articles in bag 10 when the bag is in the open position.

It will be appreciated from the foregoing that a novel and improved bag for thoroughly and safely laundering articles made of delicate fabrics, such as hosiery or lingerie, and which is simple in design and economical to manufacture has been devised. It will be evident to those skilled in the art that an important characteristic of the bag of the present invention is the arrangement of the hook and thistle portions 17 and 17' along the folded-over bands 15 and 15', the band 15 and upper edge 14 extending beyond the upper edge 14' and being capable of being folded over the band 15' so as to form a releasable closure across the upper end of the bag. In depositing articles into the bag 10, the manner of stitching or attachment of the bands 15 and 15' to the upper folded or pleated ends of the bag offer some limited give or stretchability so that the opening size can be increased. Moreover, as shown in dotted form in FIG. 3, the band 15 may be reverse-folded or doubled back upon the upper end 14 so as to be safely out of the way when articles are placed in the bag and avoid any danger of snagging of delicate fabrics with hook portion 17. Once the articles are fully inserted into the bag, the band is then folded into the closed position as shown in FIG. 4 so as to securely retain the articles within the bag during the machine laundering operation. As a result, any risk of danger to delicate fabrics such as might occur if the article became enmeshed in a conventional zipper or snaptype arrangement is literally avoided.

While the bag is shown as having the pleats 13, it will be apparent that the bag may be formed with gathers or folds, or can be formed without pleated or gathered portions 13. Also, it is desirable that the foldable band 15 extend down past the front band 15' so that the lower edge of the band 15 is coextensive and aligned with the lower edge of the band 15'. In this way, the band will not only form a broad area of attachment and reinforcing for the upper edge of the panel 14, but also permit the front band 15' to be sewn or attached at its ends directly to the band 15.

Although the present invention has been described with particularity relative to the foregoing detailed description of the preferred embodiment, various modifications, changes, additions and applications other than those specifically mentioned herein will be readily apparent to those having normal skill in the art without departing from the spirit and scope of this invention.

I claim:

1. An article carrier adaptable for use in washing and drying delicate fabrics, such as, nylon hose and the like, comprising in combination a rectangular panel of open mesh material folded upon itself in a lengthwise direction to define a lower closed end (11), an upper open end (12) and opposite sides (18 and 19), the mesh material at said upper end being gathered and folded together in a direction transversely of the length to define longitudinally extending folds (13) and to form a container (10) of generally trapezoidal configuration, a first edge (14) of said upper open end having a band (15) provided with hook portions (17) attached thereto and a second edge (14') of said upper open end having a band (15') provided with thistle portions (17') affixed thereto and projecting from said second edge, said bands (15) and (15') being stretch-stitched to said upper edges (14) and (14'), respectively, said band (15) and hook portion (17) being foldable in a first direction over said band (15') and thistle portion (17') and releasably engageable therewith solely by application of pressure, said band (15) and hook portion (17) further foldable in a direction away from said band (15'), thistle portion (17') thereon and said upper open end (12) to fully expose said upper open end, said bands (15, 15') defining an opening substantially coextensive with said upper open end (12) when said band (15) is folded away from said band (15').

2. An article carrier according to claim 1, said container (10) being of generally trapezoidal configuration in which said lower closed end (11) is on the order of two to three times greater in width than the upper open end (12).

* * * * *